United States Patent [19]

Suyama et al.

[11] Patent Number: 4,723,357

[45] Date of Patent: Feb. 9, 1988

[54] BUTTONING APPARATUS WITH OPTICAL ATTACHING-POSITION INDICATOR

[75] Inventors: Noriyoshi Suyama; Koji Omori, both of Tokyo, Japan

[73] Assignee: Scovill Japan Kabushiki Kaisha, Tokyo, Japan

[21] Appl. No.: 15,731

[22] Filed: Feb. 17, 1987

[30] Foreign Application Priority Data

May 28, 1986 [JP] Japan ..... 61-79633
May 28, 1986 [JP] Japan ..... 61-121303
May 28, 1986 [JP] Japan ..... 61-121304

[51] Int. Cl.[4] ..... B23P 21/00; B23Q 15/00

[52] U.S. Cl. ..... 29/721; 29/33 K; 29/DIG. 105; 227/18; 227/43; 227/119; 33/662

[58] Field of Search ..... 29/33 K, 720, 721, 407, 29/DIG. 105; 227/18, 43, 119, 156; 33/11, 268, 662

[56] References Cited

U.S. PATENT DOCUMENTS 3,964,661 6/1976 Schmidt et al. ..... 227/18
4,589,212 5/1986 Tame ..... 33/662
4,605,150 8/1986 Ikehara ..... 29/720 X

*Primary Examiner*—Howard N. Goldberg
*Assistant Examiner*—Ronald S. Wallace
*Attorney, Agent, or Firm*—Wood, Dalton, Phillips, Mason & Rowe

[57] ABSTRACT

A marking light, or an attaching-position indicator, for a buttoning apparatus to indicate the position where each button member is to be attached in place, comprises a slender optical pointer member, engaging means secured to the rear end of the optical pointer member for selective engagement with a part of a pusher of the buttoning apparatus, a fixing member for the indicator including a support having means to support the front end portion of the pointer member so as to be movable back and forth with respect to a position immediately below an upper attaching die of the apparatus, release means connected to the engaging means for disengaging the engaging means from a part of the pusher, and means for biasing the pointer member in the direction of withdrawal clear of the upper attaching die. The support is equipped with a resilient engaging means fixed at one end to the fixing member and so disposed as to engage resiliently a part of the support at the other end. The fixing member and the optical pointer member are further provided with a contact member each, located so that the contact members come in contact with each other at the point where the pointer member has advanced toward the plunger in response to the upward movement of the upper attaching die of the apparatus.

18 Claims, 11 Drawing Figures

BUTTONING APPARATUS WITH OPTICAL ATTACHING-POSITION INDICATOR

BACKGROUND OF THE INVENTION

This invention relates to a marking light, and more specifically to an attaching-position indicator for use with a buttoning apparatus.

Furnishing garments and the like with snap type buttons, by securing the stud or socket pieces in place with the aid of pronged or eyelet type backing members, has been performed by snap buttoning apparatuses. The equipment generally comprises an upper attaching die unit for holding each of the stud or socket pieces and a lower attaching die unit holding each pronged or eyelet piece. The snap buttoning operation proceeds in a cycle of properly positioning one side of an article of garment or the like in the space between the two attaching die units and then pressing either unit against the other with the button piece in between.

For the snap buttoning operation an optical pointer is commonly used to ensure exact attachment of each snap type button to a preselected point of the garment or the like. The optical pointer typically consists of a cylindrical member provided with a light source and a light passage formed inside. A beam of light from the source is conducted out of a tiny hole in the front end portion of the cylindrical member to indicate a point to be buttoned of a garment or the like held in place for the buttoning apparatus.

The optical pointer has been variously designed to avoid hampering the smooth forced contact between the two attaching die units in the clinching cycles during buttoning operation Japanese Utility Model Application No. 200487/1983, filed Dec. 29, 1983 (equivalent to U.S. Pat. No. 1,605,150 issued Aug. 12, 1986 to Ikehare) for example, discloses an attaching-position indicator integrally secured to a pusher of a buttoning apparatus that feeds each stud or socket piece or each eyelet or pronged member of a button, forcing it horizontally into an upper or lower die. In the attaching-position indicator the optical pointer protrudes beyond the front end of the pusher and, when the pusher has completed its advance, the pointer end is positioned above the center of the buttoning point.

A similar construction is described in Japanese Patent Application No. 12403/1976, filed Apr. 19, 1976, with optical pointers of such construction it is necessary to form the optical pointer to a restricted shape, say elongate or slender, to suit the region where it is installed, because the region is restricted by the extension of the optical pointer end beyond the center of the buttoning point whereas the backstroke of the pusher remains unchanged. Since the return speed of the pusher is also constant, the front end position of the optical pointer must be carefully chosen with respect to the vertical position between the two attaching dies lest it contact the descending upper die. These limitations render it difficult to determine the optimum location for mounting the attaching-position indicator in the buttoning apparatus. A further disadvantage is that the optimum location so found will necessitate some additional improvement in the buttoning apparatus. Moreover, the attaching-position indicators of the construction described have the danger of destroying the optical pointer, when the front end of the pointer fails to recede for some reason, by the strike of the descending upper die against the pointer end and by consequent exertion of an excessive force on the pointer.

As noted above, the optical pointer members of the prior art usually comprise a tubular member having a built-in light source and a light passage formed inside to conduct a beam of light from the source. The front end portion of the tubular member has a tiny hole on the underside through which the beam of light from the internal light passage is emitted downwardly.

Electric wires, for example, vinyl-covered ones, are used as parts for current supply to the light source. These wires either connect source terminals provided on the buttoning apparatus body and on the optical pointer member or are directly drawn in through holes formed in the pointer member to the light source.

A problem common to the wire parts is that the fatigue of the vinyl coat and the wire core is accelerated by the repetition of straining and stretching due to the repeated backward and forward movements of the optical pointer member with respect to the upper attaching die as described above. Another problem is the possibility of the operator inadvertently touching the wires located in the proximities of complex mechanical parts. This can apply an excessive force to the wires, sometimes such as to break them easily.

SUMMARY OF THE INVENTION

It is a principal object of the present invention to provide an attaching-position indicator adapted to be mounted simply and conveniently in a buttoning apparatus.

Another object of the invention is to provide an attaching position indicator wherein the optical pointer can be reset faster than the pusher of the buttoning apparatus.

Still another object of the invention is to provide an attaching-position indicator equipped with a safety device whereby the optical pointer is protected at the time the upper attaching die of the buttoning apparatus strikes against the pointer.

Yet another object of the invention is to provide such a safety device simplified in construction.

A further object of the invention is to omit electric wires for the interconnection of the components in an attaching-position indicator for use with a buttoning apparatus.

An additional object of the invention is to provide a buttoning apparatus and an attaching-position indicator both of which are fitted with contact members for selectively connecting and disconnecting them electrically.

These objects of the invention are attained by providing an attaching-position indicator for a buttoning apparatus which comprises a slender optical pointer member, engaging means secured to the rear end of the optical pointer member for selective engagement with a part of a pusher of the buttoning apparatus, a fixing member for the attaching-position indicator including a support having means to support the front end portion of the optical pointer member so as to be movable backward and forward with respect to a position immediately below an upper attaching die of the buttoning apparatus, release means connected to the engaging means for disengaging the engaging means from a part of the pusher, and biasing means for biasing the optical pointer member in the direction of withdrawal clear of the upper attaching die. The support is equipped with a resilient engaging means fixed at one end to the fixing member and so disposed as to engage resiliently a part of the support at the other end. The fixing member and the optical pointer member both of which constitute the attaching-position indicator are further provided with a contact member each. The contact members are located so that they come in contact with each other at the point where the optical pointer member has advanced toward the plunger in response to the upward movement of the upper attaching die of the buttoning apparatus.

DETAILED DESCRIPTION

With the construction in conformity with the invention, the attaching-position indicator operates in such a way that it engages the pusher that moves toward the upper attaching die of the buttoning apparatus when the die moves upward, so that the front end of the optical pointer is moved to a position immediately below the upper attaching die. It is then disengaged from the pusher immediately before the upper attaching die begins to descend. Consequently, the optical pointer is quickly withdrawn by the biasing means from the upper attaching die, at a speed higher than the returning speed of the pusher, thus avoiding the strike of the descending upper attaching die against the optical pointer member.

The attaching-position indicator of the invention is secured to a stationary part of the buttoning apparatus and therefore is free from the difficulties otherwise involved in the attachment to a movable part.

The safety device according to the invention provides protection for the buttoning apparatus, through the disengagement of the resilient engaging means from the support, when the optical pointer member that has fulfilled its function fails to recede for some reason while the upper attaching die of the buttoning apparatus is descending together with the plunger and allows the die to hit the front end of the member.

An attaching-position indicator embodying the present invention will now be described in detail with reference to the accompanying drawings.

Figure 1:
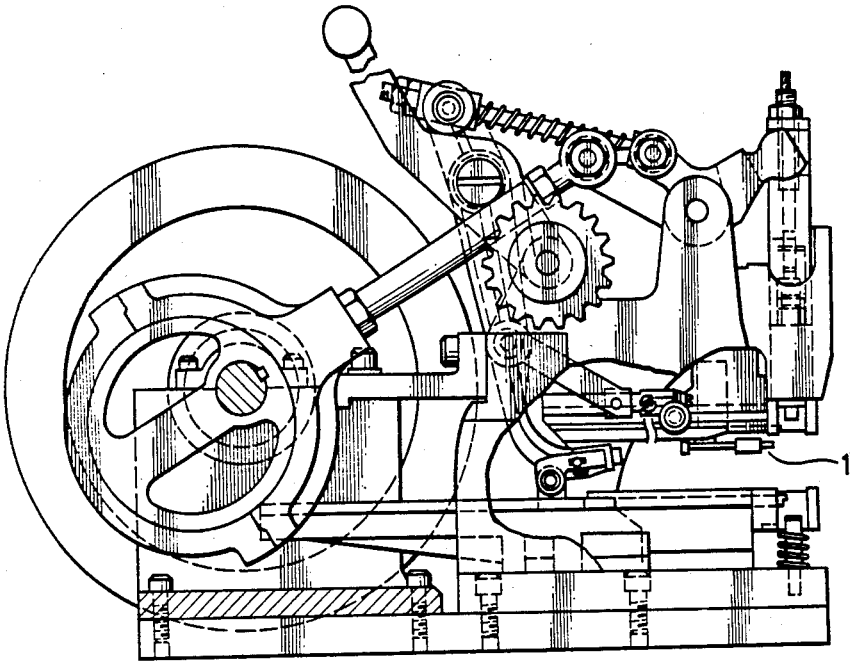
FIG. 1 is a general side view of a buttoning apparatus equipped with an attaching-position indicator embodying the present invention.
Figure 2:
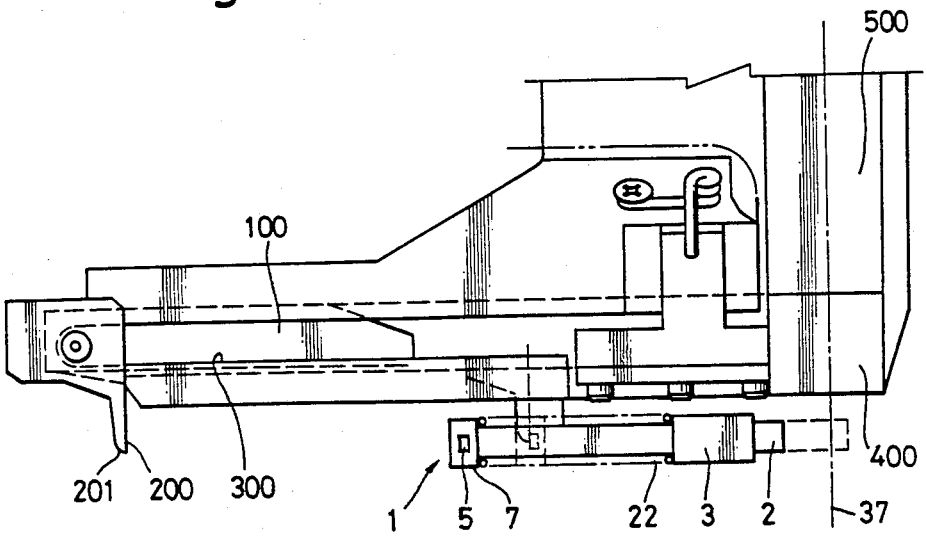
FIG. 2 is a fragmentary side view of the buttoning apparatus with the attaching-position indicator of the invention.

Referring first to FIGS. 1 and 2, the attaching-position indicator 1 of the invention is shown secured to a part of a buttoning apparatus.

In the buttoning apparatus incorporating the attaching-position indicator of the invention, each of button members (not shown) is fed in a guide groove 300 to a point ahead of a pusher 100, and is forced in the groove rightward as viewed in FIG. 2 by the pusher 100 until it is held in place within an upper attaching die 400 supported at the lower end of a plunger 500, which is in its upper, raised position. As the plunger 500 is driven downward, the pusher 100 withdraws along the guide groove 300. Upon return of the pusher to its original position, another button member is charged at its front.

Figure 3:
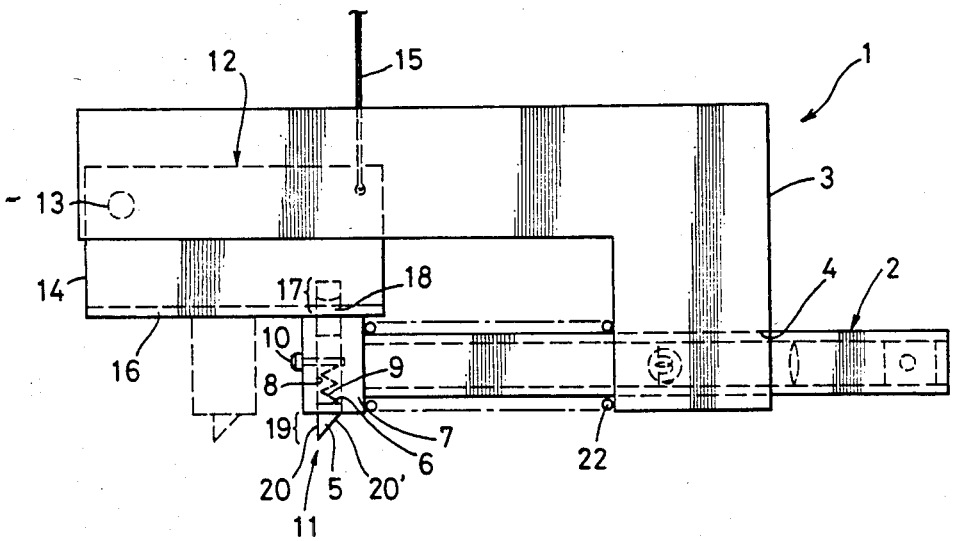
FIG. 3 is a front view of the attaching-position indicator of the invention.

Referring next to FIG. 3, the attaching-position indicator 1 of the invention, in turn, comprises an optical pointer member 2 inserted through a hole 4 formed in a fixing member 3.

At the rear end of the optical pointer, there is mounted an assembly of engaging means, as shown in FIG. 3, comprising a claw member 5, a claw member housing 7 having a transverse through hole 8 adapted to receive the claw member 5, and a claw member spring 9 biasing the claw member 5 in the direction normal to the axis of the optical pointer, and a claw member holding pin 10 which keeps the claw member 5 from dropping off from the housing 7.

A pivot pin 13 is secured to a point of the fixing member 3 close to the engaging means 11 so as to permit the turning of a release means 12 to be described below.

The release means 12 comprises a rectangular plate 14 and a length of wire 15 connected at one end to a part of the plate 14 and at the other end to a foot pedal (not shown) for turning on or off a switch to start the buttoning apparatus. The rectangular plate 14 is turnably supported by the pivot pin at one end opposite to the end where it is connected to the wire. One longitudinal edge of the rectangular plate adjacent the engaging means 11 is bent downward throughout to form a depending edge 16.

The claw member 5 in the housing 7 has a first end 17 projecting toward the rectangular plate, the end being formed with a groove 18 adapted to receive and engage the depending edge of the plate. It has a second end 19 projecting opposite to the first, to a given length, preferably by about 5 mm, from the claw member housing 7 for selective engagement with the pusher. The second end 19 has a planar face 20 on the side rearward of the optical pointer and a tapered face 20' on the side frontward of the pointer.

Figure 5:
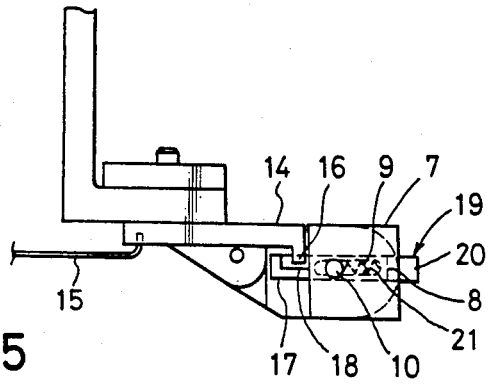
FIG. 5 is a sectional view as seen in the direction of arrows A in FIG. 3.
Figure 6:
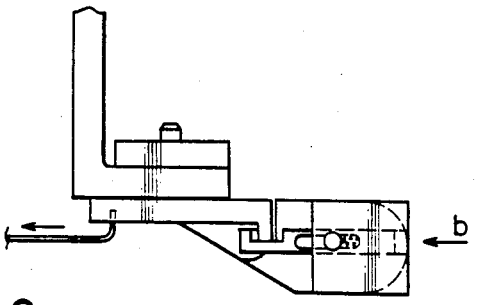
FIG. 6 is a sectional view similar to FIG. 5 but showing the release means in action.
Figure 7:
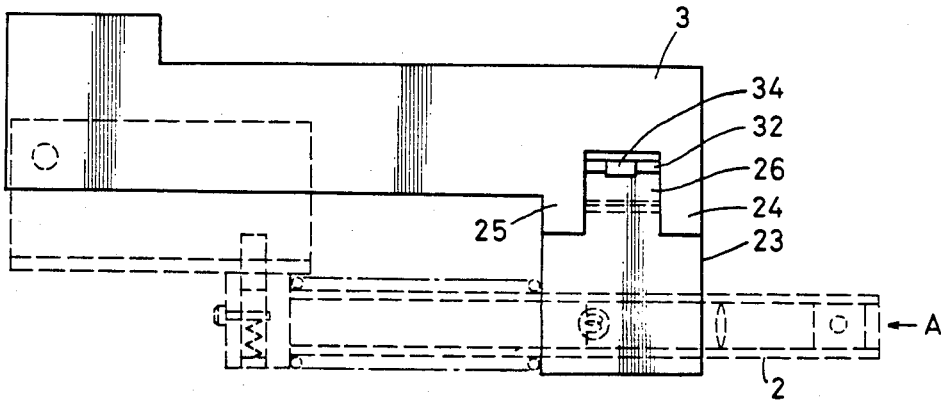
FIG. 7 is a plan view of a safety device embodying the invention.

A long slot 21 (FIG. 5) is formed in the intermediate portion of the claw member 5. The claw member holding pin 10 as shown is inserted through the slot 21 across the claw member housing 7 through holes formed therein. In the space of the slot 21 between the claw member holding pin 10 and the second end, there is fitted the spring 9 to generate a force to bias the claw member 5 normally in the direction of the second end.

Another spring 22 is fitted (FIG. 3) over the portion of the optical pointer 2 between the fixing member and the release means. The spring 22 exerts a force through the release means against the optical pointer 2, when the latter moves frontward, or rightward as viewed in FIG. 3, to pull it back leftward.

An actuating contactor 200 for operating the attaching-position indicator of the invention (FIG. 2) is integrally secured to a part of the pusher 100. The contactor 200 is adapted to move together with the pusher along the guide groove 300 so that a part of it is positioned to engage the flat face 20 of the claw member 5.

Figure 4:
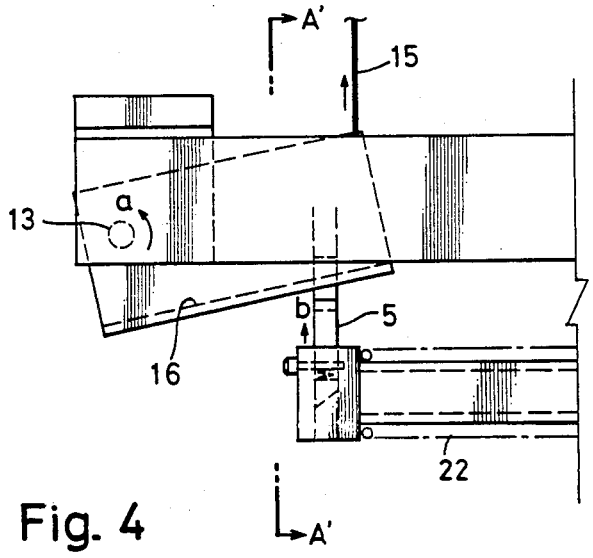
FIG. 4 is a fragmentary front view of the attaching-position indicator, illustrating the function of the release means.

In the operation of the apparatus, the pusher 100 is first driven toward the plunger, or rightward as viewed in FIG. 2, bringing a part of the actuating contactor 200 into engagement with the flat face 20 of the claw member 5. The optical pointer too is accordingly moved rightward until its front end is positioned immediately below the upper attaching die of the plunger. Next, the foot pedal is depressed to lower the plunger, whereby the wire 15 connected to the pedal is caused to pull the rectangular plate 14, turning the latter about the pivot pin 13 in the direction of the arrow a in FIG. 4. The turn of the rectangular plate 14 causes the depending edge 16 to pull out the claw member 5 in the direction of the arrow b in FIG. 4, retracting and disengaging the flat face 20 of the claw member from the actuating contactor 200 of the pusher. Thereupon the optical pointer 2 is quickly reset leftward in FIG. 3, or to the starting point, by the repulsive force of the spring 22. The pusher 100 and the actuating contactor 200 then begin returning likewise toward the left in FIG. 3. The rear end 201 of the contactor 200 comes in contact with the tapered face 20' of the claw member of the release means reset beforehand to the initial position, and thereby forces the claw member 5 into its housing 7. This enables actuating contactor 200 to return to the starting point without any obstruction by the resistance of the claw member 5. A support 23 is connected to the fixing member 3 by a linkage (FIG. 8) preferably including a connecting shaft, or a pin 24, held in parallel with the optical pointer 2. The fixing member 3, as described above, can also be used to fix the attaching-position indicator to a part of the buttoning apparatus.

The support 23 has a projection 26 so shaped as to fit in the space formed between a pair of projections 24 and 25 of the fixing member. A pin 28 is inserted through holes 27 formed in alignment in these projections 24, 25, and 28. The front end surface 29 of the projection of the support 23 is tapered downward and toward the tip 30, as indicated by a broken line in FIG. 8. In this way a clearance 32, preferably on the order of 3 mm, is provided between the front end surface 29 of the support and the opposing recessed surface 31 of the fixing member 3.

Figure 8:
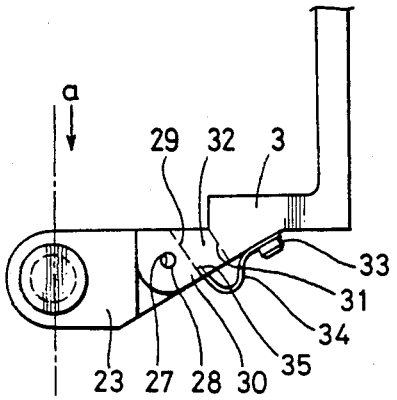
FIG. 8 is a sectional view of the safety device as viewed in the direction of the arrow A in FIG. 7.

A leaf spring 34 is fastened at one end to the underside of the fixing member 3 by a screw 33 or the like. As illustrated in FIG. 8, the free end 35 of the leaf spring 34 fits in the clearance 32 and is engaged, over a minimum length, with the front end 30 of the support. The spring 34 thus can exert a sufficient repulsive force against the support 23 to keep it in the horizontal state as shown in FIG. 8.

Figure 9:
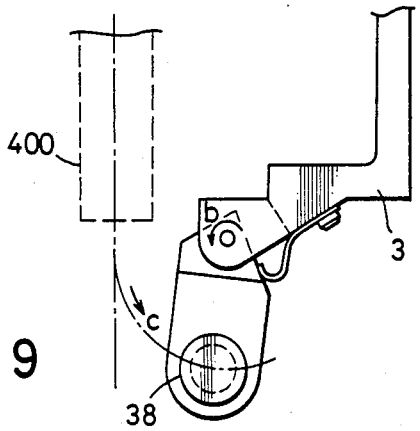
FIG. 9 is a sectional view similar to FIG. 8 but showing the safety device in action.
Figure 10:
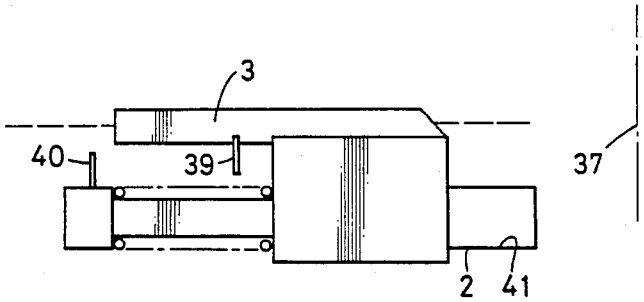
FIGS. 10 and 11 are sequential side views of the optical pointer member advancing toward a position where it crosses the centerline of the plunger and where the electric contact members come in contact.

The arrangement described above, or a safety device according to the invention, is shown in action in FIG. 9. There is a possibility of the optical pointer failing, for some unexpected reason, to return to the starting position, or recede clear of the upper attaching die 400 during the downward movement of the die. When this happens, the upper attaching die 400 strikes against the front end 38 of the optical pointer. The impact of the strike combines with the pressure thenceforth applied by the plunger to produce a force with which to turn the front end 30 of the support 23 about the pin 28 in the direction of the arrow b. The turning force overcomes the repulsive force of the spring 34 to disengage the support 23 from the leaf spring 34 while, at the same time, forcing the whole support 23 to turn about the pin 38 in the direction of the arrow c.

The downturn of the support avoids further strike of the upper attaching die against the optical pointer end protects the pointer from damage by any excessive pressing force of the plunger.

Figure 11:
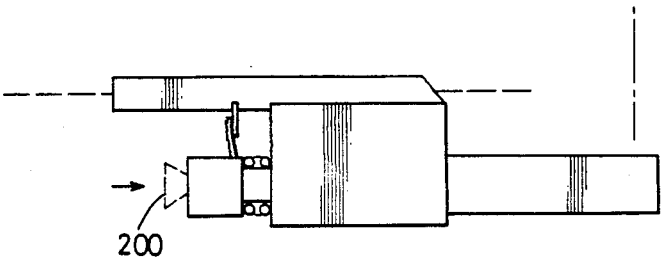

An electric contact member 39 of conductive material is fixed to a part of the fixing member, and another electric contact member 40 of similar material to a part of the optical pointer. To the contact member 39 is connected one end of a stationary electric wire (not shown) which, for example, is incorporated in the main body of the buttoning apparatus and connected at the other end to an electric source for current supply to the contact member 39. The contact member 40 on the optical pointer is extended through the pointer for connection with a light source. These electric contact members 39 and 40 are located so that they come in contact when the optical pointer 2 has been forced rightward as viewed in FIG. 11 by the actuating contactor 200 to a point where a light-receiving through hole 41 formed in the front end portion of the pointer is aligned to the central axis 37 of the plunger. The two electric contact members having come in contact in this way, current flows from the member 39 to the member 40, lighting up the light source.

While the present invention has been described in connection with a preferred embodiment thereof, it should be noted that various changes and modifications may be made without departing from the spirit of the invention.

What is claimed is:

1. An attaching-position indicator for a buttoning apparatus to indicate the position where each button member is to be attached in place, comprising a slender optical pointer member, engaging means secured to the rear end of the optical pointer for selective engagement with a part of a pusher of the buttoning apparatus, a fixing member provided with means for supporting the front end portion of the optical pointer member with respect to a position immediately below an upper attaching die of the buttoning apparatus so that the member with the first end portion is movable backward and forward correspondingly to the downward and upward movements, respectively, of the upper attaching die, release means connected to the engaging means for disengaging the engaging means from a part of the pusher, and biasing means for biasing the optical pointer member in the direction of withdrawal clear of the upper attaching die.

2. The indicator of claim 1 wherein the optical pointer member has a built-in light source and a light passage formed therein and is formed with a light-emitting hole at one end thereof.

3. The indicator of claim 1 wherein the means for supporting includes holes formed in the fixing member of the indicator.

4. The indicator of claim 1 wherein the engaging means comprises a claw member so disposed as to be movable transversely of the optical pointer member and a claw member housing for holding the claw member therein.

5. The indicator of claim 1, wherein the claw member constituting the engaging means is biased by a spring to protrude a given length tranversely of the optical pointer member.

6. The indicator of claim 1 wherein the release means comprises a slender plate adapted to engage edgewise with the engaging means and a wire connected at one end to a food pedal for turning on or off a switch to operate the buttoning apparatus and connected at the other end to the slender plate.

7. The indicator of claim 1 wherein the claw member constituting the engaging means has a side opposite to the side where it engages a part of the pusher, said first side being tapered at an acute angle to the pusher-engaging side.

8. The indicator of claim 1 wherein the release means is adapted to function during the downward movement of the upper attaching die.

9. The indicator of claim 1 wherein the biasing means is a spring disposed between the engaging means of the optical pointer member and the fixing member.

10. The indicator of claim 1 wherein the supporting means further comprises a resilient engaging means pivotally secured to the fixing member and fastened at one end to the fixing member and so disposed as to be resiliently engageable at the other end with a part of the supporting means.

11. The indicator of claim 10 wherein the resilient engaging means is a leaf spring.

12. The indicator of claim 10 wherein the resilient engaging means is adapted to be disengaged, when the upper attaching die has come in contact with the optical pointer member, by the force the die exerts for the contact.

13. The indicator of claim 10 wherein the supporting means is connected to the fixing member by a connecting shaft extending in parallel with the optical pointer member.

14. The indicator of claim 10 wherein the supporting means is turnable about the part where it is connected to the fixing member.

15. The indicator of claim 1 wherein the fixing member and the optical pointer member further comprise electric contact members, one for each.

16. The indicator of claim 15 wherein the electric contact members are so located as to come in contact when the optical pointer member has advanced to a position immediately below the upper attaching die of the buttoning apparatus upon the ascent of the die.

17. The indicator of claim 15 wherein the electric contact members are welded to the fixing member and the optical pointer member.

18. The indicator of claim 15 wherein the electric contact members are made of conductive material.

* * * * *